United States Patent [19]

Rosen

[11] Patent Number: 4,772,172

[45] Date of Patent: Sep. 20, 1988

[54] LOW PROFILE VEHICLE PARKING APPARATUS

[76] Inventor: Arnold M. Rosen, 77 S. Washington Ave., Bergenfield, N.J. 07621

[21] Appl. No.: 72,861

[22] Filed: Jul. 14, 1987

[51] Int. Cl.[4] ..... B66F 7/04

[52] U.S. Cl. ..... 414/240; 187/8.59; 187/8.71; 187/17; 414/228; 254/89 H; 254/8 C

[58] Field of Search ..... 414/227, 228, 229, 233, 414/239, 240, 249, 250, 592, 678, 921, 540, 541, 545; 187/8.41, 8.71, 8.43, 8.59, 17, 8.49; 254/2 R, 2 B, 2 C, 3 R, 3 B, 3 C, 8 R, 8 B, 8 C, 93 L, 89 H, 93 R

[56] References Cited

U.S. PATENT DOCUMENTS

| | | | |
|---|---|---|---|
| 1,620,256 | 3/1927 | Heise | 414/545 |
| 2,701,654 | 2/1955 | Williamsen | 414/545 |
| 3,706,356 | 12/1972 | Herbst et al. | 414/228 X |
| 4,209,276 | 6/1980 | Rosen | 414/240 |
| 4,531,614 | 7/1985 | Naegeli | 187/8.41 X |

FOREIGN PATENT DOCUMENTS

| | | | |
|---|---|---|---|
| 2709203 | 9/1978 | Fed. Rep. of Germany | 414/229 |
| 1395365 | 3/1965 | France | 414/545 |

*Primary Examiner*—Frank E. Werner

*Attorney, Agent, or Firm*—Anthony J. Casella; Gerald E. Hespos

[57] ABSTRACT

A low profile vehicle parking apparatus is provided. The apparatus comprises a base and a pair of upstanding stanchions. A vehicle parking platform is disposed between and movable along the stanchions. An articulated stabilizer bar assembly comprising a rocker arm and a control arm are pivotally connected to one another and to the parking platform and base respectively. A piston and cylinder assembly extends pivotally from a fixed location to a pivotal location on the articulated stabilizer bar assembly. Thus, the piston and cylinder assemblies do not add to the height of the apparatus and contribute to the stabilization during the lifting of a vehicle on the parking platform.

7 Claims, 3 Drawing Sheets

LOW PROFILE VEHICLE PARKING APPARATUS

BACKGROUND OF THE INVENTION

A vehicle parking apparatus is employed to enable two vehicles to be parked in a surface area that approximately corresponds to the area of a standard vehicle parking space. More particularly, the vehicle parking apparatus includes a platform onto which a first vehicle is driven. The apparatus then raises the platform and the vehicle thereon a sufficient distance to enable a second vehicle to be parked underneath.

Vehicle parking apparatuses of this type are widely used in urban areas of the United States where the land available for parking vehicles is extremely limited and where property values and building costs are extremely high. For example, prior art devices of this type have been employed in open parking lots in New York to approximately double the number of cars that can be parked. In many European, South American and Asian cities, the parking problems are even more acute, and prior art vehicle parking devices are very widely used.

It is believed that parking problems in urban areas in both the United States and other countries will become worse as populations continue to increase, open spaces in urban areas becomes less available and vehicles become more prevalent.

To date, the above described vehicle parking apparatus has been widely used in open vehicle parking lots and to a considerably lesser extent in vehicle parking garages. The lower usage of vehicle parking apparatuses in parking garages is partly attributable to the height requirements of the parking apparatus. For example, an extremely effective prior art vehicle parking apparatus is shown in U.S. Pat. No. 4,209,276 which issued to the applicant herein on June 24, 1980. The disclosure of U.S. Pat. No. 4,209,276 is incorporated herein in its entirety by reference. The parking apparatus shown in U.S. Pat. No. 4,209,276 includes a base having a pair of spaced apart upstanding stanchions extending therefrom. The stanchions are spaced from one another a sufficient distance to enable a vehicle to be driven therebetween. A pair of hydraulic piston and cylinder assemblies are rigidly mounted respectively to the stanchions to extend upwardly from the tops of the stanchions. The pistons are connected to a platform or ramp onto which the vehicle may be driven. The platform is movable along the stanchions under the action of the hydraulic piston and cylinder assembly. Thus, the hydraulically actuated withdrawal of the pistons into the corresponding cylinders will lift the platform with the vehicle thereon a distance equal to the movement of the piston which must be sufficient to enable a second vehicle to be driven between the stanchions and under the platform. To ensure that the vehicle on the platform is elevated evenly despite the possibility of uneven weight distribution in the vehicle, the apparatus shown in U.S. Pat. No. 4,209,276 includes stabilizer bar linkages which extend from the base to the platform to stabilize the platform and to provide an even lifting of the vehicle.

Despite the many advantages of the vehicle parking apparatus shown in U.S. Pat. No. 4,209,276, the apparatus defined by the stanchions and the large pistons extending up from the stanchions occupies a total height of approximately 11′ 4″, which exceeds the floor to ceiling height in many parking structures.

Another prior art parking apparatus is shown in British Patent No. 2,051,004 which issued to Roshier on Mar. 16, 1983. The apparatus shown in British Patent No. 2,051,004 is very similar to the prior art vehicle parking apparatus shown in the above described U.S. Pat. No. 4,209,276. However, the apparatus shown in British Patent No. 2,051,004 includes a piston and cylinder assembly wherein the cylinder is mounted to the base adjacent the stanchion and wherein the piston is connected to a vertical member extending upwardly from the platform on which the vehicle is parked. Thus, the pushing movement of the piston from the cylinder acts through the vertical member to lift the platform on which the vehicle is supported a distance exactly equal to the movement of the piston. The apparatus shown in British Patent No. 2,051,004 has several deficiencies. In particular, it is generally considered undesirable to provide a piston/cylinder apparatus, such as this, wherein the work is done on the pushing movement of the piston. More particularly, the relatively slender piston remains substantially entirely exposed and under compression throughout the entire period that a vehicle is supported in an elevated condition on the platform. An uneven weight distribution can create moments in the piston with a likelihood of bending or buckling. To prevent buckling, the piston must have a relatively large cross section, thereby adding to the cost of the piston and cylinder assembly. Inadvertent contact with the piston can easily occur in the environment of the parking lot or garage, thus further increasing maintenance requirements. Additionally, in the elevated condition of the vehicle, the piston would extend to a height beyond the platform by a distance equal to the length of the vertical member connecting the piston to the platform.

In view of the above, it is an object of the subject invention to provide a parking apparatus that can be used in many indoor parking structures.

Another object of the subject invention is to provide a vehicle parking apparatus that has a lower height than prior art vehicle parking devices.

Another object of the subject invention is to provide a low profile vehicle parking apparatus that enables the vehicle to be lifted on the pulling stroke of the piston and cylinder assembly.

Still a further object of the subject invention is to provide a vehicle parking apparatus that effectively coordinates the lifting members with the stabilizing members to ensure an efficient and stable lifting movement within a low profile space envelope.

SUMMARY OF THE INVENTION

The vehicle parking apparatus of the subject invention comprises a pair of stanchions extending rigidly upwardly from a base, and a vehicle parking platform which is movable along the stanchions. Articulated stabilizing bar assemblies extend from the parking platform to the base. Each articulated stabilizing bar assembly comprises a rocker arm and a control arm which are articulated to one another. The rocker arm is further articulated to the parking platform, and the control arm is articulated to the base.

The vehicle parking apparatus further comprises a pair of piston and cylinder assemblies each having a first end pivotally mounted to fixed locations, and a second end pivotally mounted to portions of the rocker arm spaced from the parking platform and from the control arm. In a preferred embodiment, explained in greater detail below, the first ends of the piston and cylinder assemblies are mounted to portions of the stanchions remote from the base; however, these first ends may be pivotally mounted to the base or some other fixed location.

The connection of the piston and cylinder assembly to the articulated stabilizing bar assembly may be such that the maximum extension of the piston and cylinder assembly substantially corresponds to the alignment of the stabilizing bar assembly in the lowest position of the parking platform. Conversely, the connections of the piston and cylinder assembly with the articulated stabilizing bar assembly may be such that the piston will be fully retracted within the cylinder when the stabilizing bar assembly is in the fully elevated position of the parking platform. Thus, the piston may be in its desirable fully retracted position relative to the cylinder when it is doing its work of retaining the vehicle in an elevated condition relative to the base. Furthermore, the subject vehicle parking assembly achieves the desirable attribute of combining the vehicle lifting function with the vehicle stabilizing function. In particular, the lifting of the vehicle is carried out through the articulated stabilizing bar assembly to achieve a controlled lifting and stabilizing function simultaneously. This combination achieves substantially improved stabilization which is extremely important in view of the wide variations of vehicle weights and centers of gravity.

The above described connections enable a relatively small movement of the piston to achieve a relatively great movement of the parking platform. Consequently, the parking apparatus of the subject invention achieves the extremely desirable attribute of having a very low profile to enable the use of the parking apparatus within indoor parking facilities that previously could not accept such parking devices. More particularly, the maximum height of the subject vehicle parking apparatus is substantially equal to the height of the stanchions. Thus, the subject apparatus with an elevated vehicle thereon assumes a maximum height of between approximately 9.5 feet and 10 feet.

DETAILED DESCRIPTION OF THE PREFERRED EMBODIMENT

Figure 1:
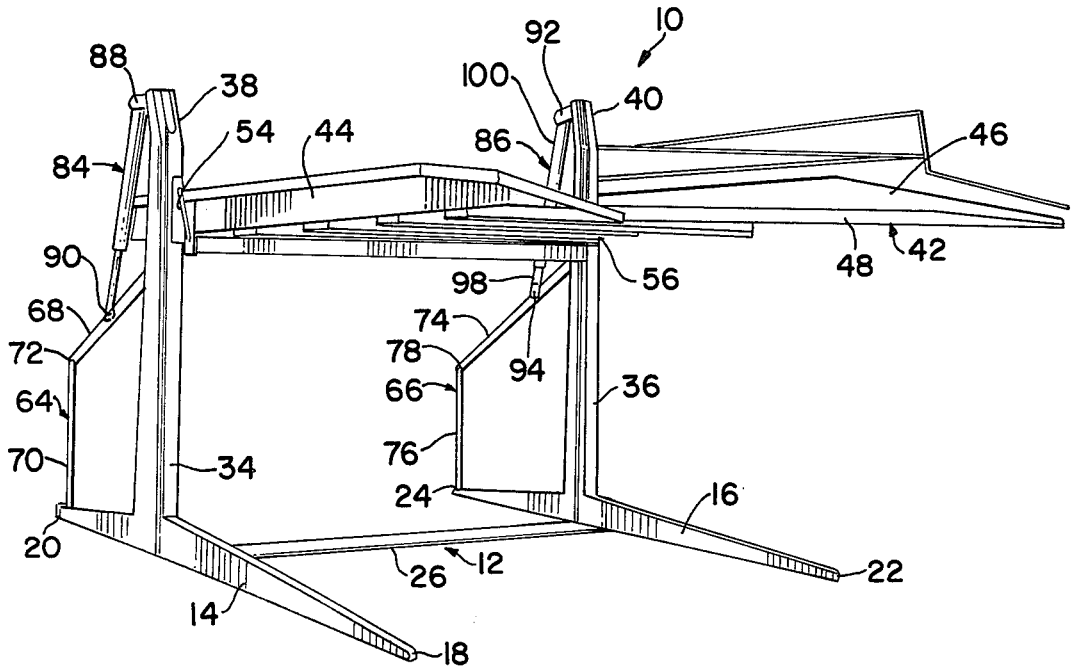
FIG. 1 is a perspective view of the low profile vehicle parking apparatus of the subject invention.

The vehicle parking apparatus of the subject invention is indicated generally by the numeral 10 in FIGS. 1–4. The parking apparatus 10 includes a base 12 which comprises first and second longitudinally extending support legs 14 and 16 which are disposed in spaced parallel relationship to one another as shown in FIG. 1. More particularly, the distance between the longitudinally extending support legs 14 and 16 is selected to exceed the maximum anticipated width of any vehicle to be parked on the apparatus 10. The longitudinally extending support leg 14 includes opposed front and rear ends 18 and 20, while the longitudinal extending support leg 16 includes opposed front and rear ends 22 and 24. The length defined by the respective longitudinal support legs 14 and 16 typically will be selected to be slightly less than the overall length of a vehicle to be parked on the apparatus 10.

The base 12 further includes a transverse support 26 which extends between and connects the respective longitudinal support legs 14 and 16. More particularly, the transverse support 26 is rigidly joined to the longitudinal supports 14 and 16 at locations intermediate the respective front ends 18 and 22 and rear ends 20 and 24 thereof respectively. The transverse support 26 is dimensioned and configured to have a low profile to permit a vehicle to be readily driven over the transverse support 26 at a slow speed.

The parking apparatus 10 further includes a pair of upstanding stanchions 34 and 36 which are rigidly connected to and extend from the respective longitudinal support legs 14 and 16 of the base 12. More particularly, the stanchions 34 and 36 extend substantially perpendicularly from the longitudinal support legs 14 and 16. However, the ends 38 and 40 of the stanchions 34 and 36 remote from the longitudinal supports 14 and 16 are angled in a rearward direction. This rearward angle of ends 38 and 40 of the stanchions 34 and 36 ensures a proper rearward sloping of a vehicle elevated by the apparatus 10 as explained herein. Additionally, the stanchions 34 and 36 preferably are configured to define track means as explained in the above cited U.S. Pat. No. 4,209,276, the disclosure of which is incorporated herein by reference.

The parking apparatus 10 further comprises a parking platform 42 which is mounted for movement along the stanchions 34 and 36. More particularly, the parking platform 42 includes a pair of longitudinally extending side rails 44 and 46 respectively and a central plate 48. The central plate 48 defines the surface on which a vehicle is parked and supported for elevation by the apparatus 10. The parking platform 42 further comprises follower means 54 and 56 for positively engaging and facilitating movement of the parking platform 42 relative to the stanchions 34 and 36. The follower means 54 and 56 may comprise wheels which are dimensioned to positively engage corresponding channels in the stanchions 34 and 36 in the manner described in the above cited U.S. Pat. No. 4,209,276. The follower means 54 and 56 are specifically adapted to follow the angled ends 38 and 40 of the stanchions 34 and 36 to permit a tilting of the platform 42 as it approaches its uppermost position.

Figure 2:
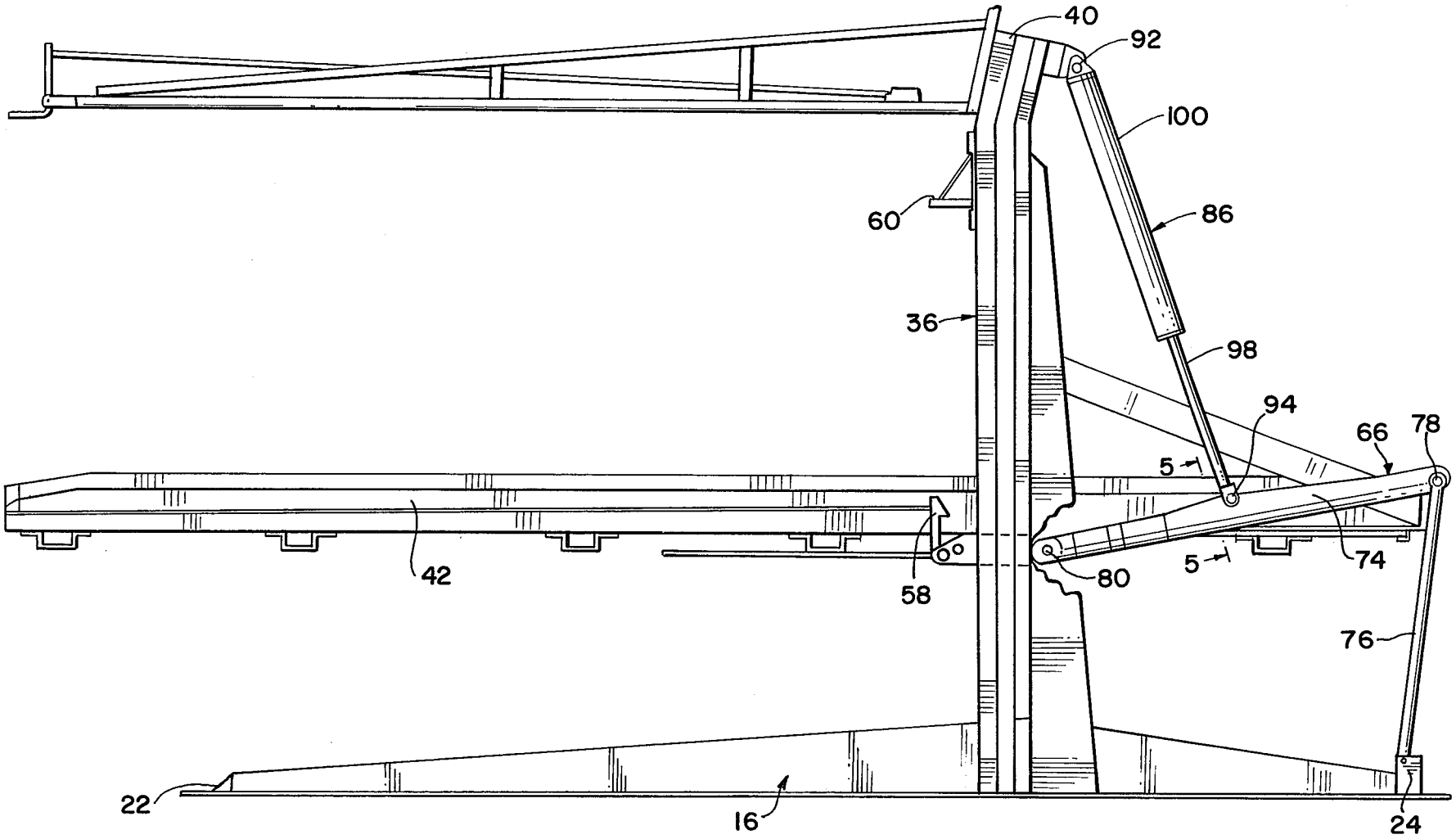
FIG. 2 is a side elevational view of the low profile vehicle parking apparatus of the subject invention.
Figure 4:
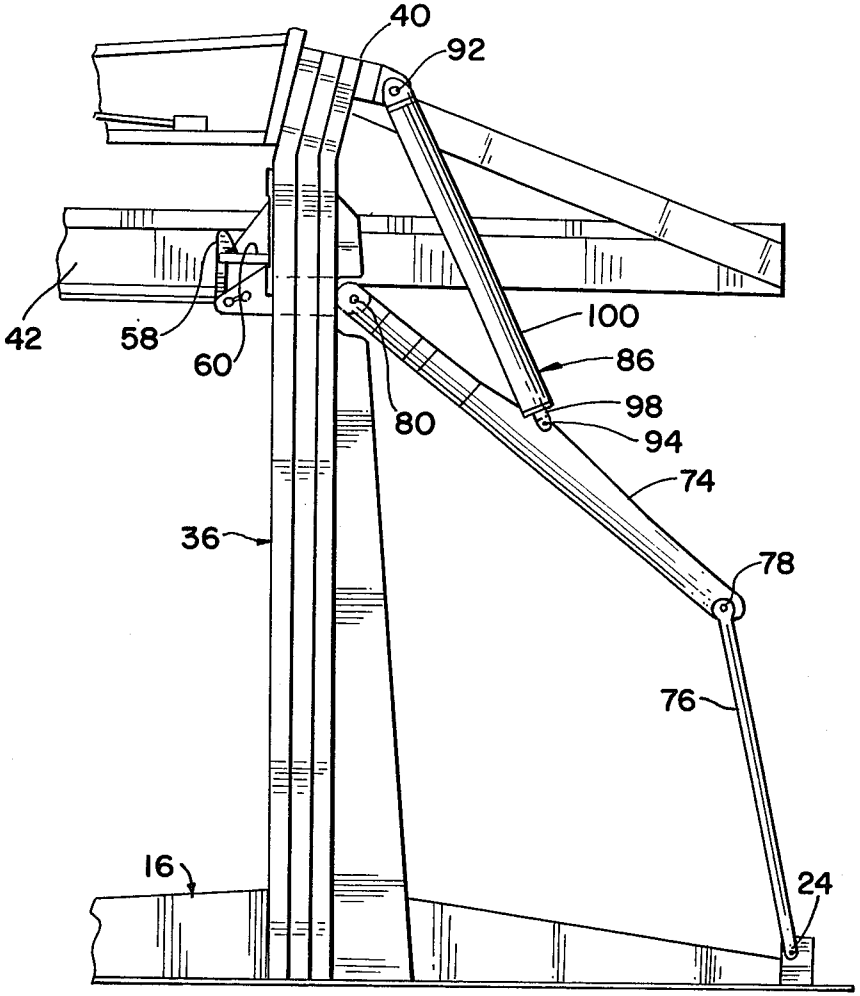
FIG. 4 is a side elevational view of a portion of the vehicle parking apparatus in its highest operational position.
Figure 3:
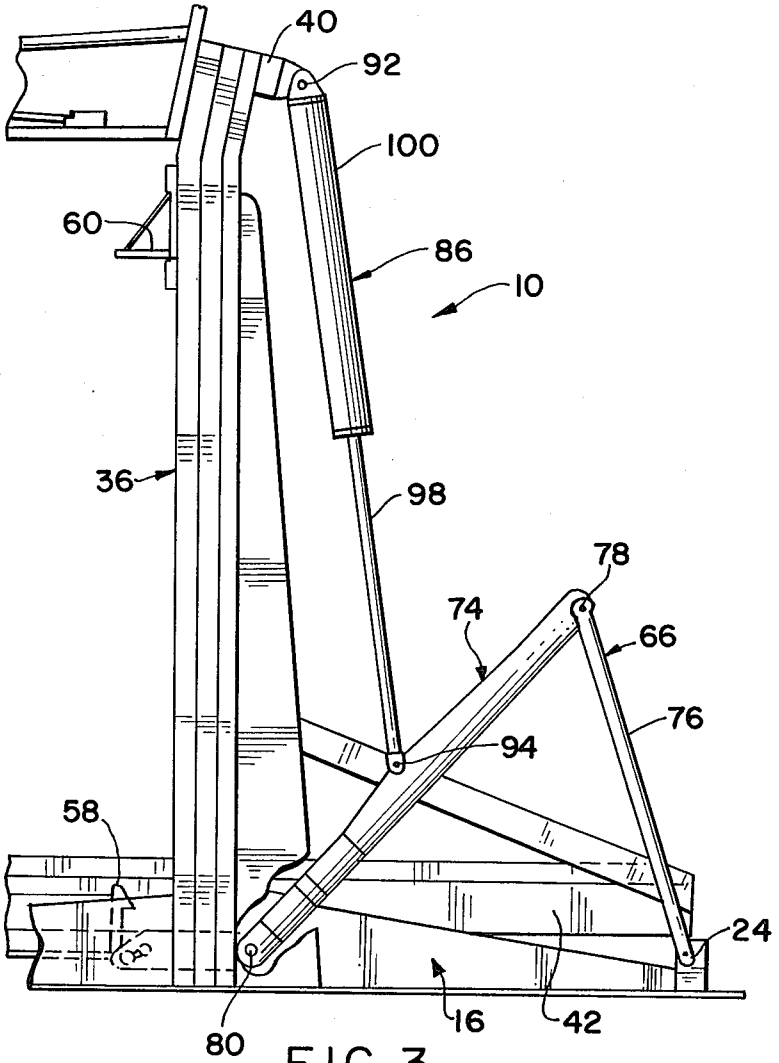
FIG. 3 is a side elevational view showing a portion of the vehicle parking apparatus in its lowest operational position.

The parking platform 42 further includes latch means 58 mounted adjacent the side rail 46 as shown in FIGS. 2–4. The latch means 58 is operative to engage a locking support 60 adjacent the top ends 40 of the stanchions 36. Thus, the latch means 58 is operative to mechanically engage the locking support 60 to keep the parking platform 42 in its elevated condition. The latch means 58 may be selectively released when a vehicle on the parking platform 42 is to be lowered. Similar latch means and locking supports (not shown) may be provided adjacent the side rail 44.

The low profile parking apparatus 10 further comprises articulated stabilizer bar assemblies 64 and 66 which contribute to the efficient and even lifting and lowering of the parking platform 42. More particularly, the articulated stabilizing bar assembly 64 extends between the side rail 54 and the longitudinal support 14, while the articulated stabilizer bar assembly 66 extends between the side rail 46 and the longitudinal support 16.

The articulated stabilizer bar assembly 64 comprises a rocker arm 68 and a control arm 70 which are articulated to one another at pivot point 72. The rocker arm 68 is pivotally connected to the side rail 54, while the control arm 70 is pivotally connected to the longitudinal support 14 adjacent end 20 thereof. In a similar manner, the articulated stabilizer bar assembly 66 comprises rocker arm 74 and control arm 76 which are articulated to one another at point 78. The rocker arm 74 is further pivotally connected to the side rail 46 at pivot point 80 as shown in FIGS. 2–4, while the control arm 76 is pivotally connected to the longitudinal support 16 adjacent the rear end 24 thereof.

The raising and lowering of the parking platform 42 is achieved by substantially identical piston/cylinder assemblies 84 and 86 shown in FIG. 1. The piston and cylinder assembly 84 extends from pivot point 88 adjacent the top end 38 of the stanchion 34 to pivot point 90 on the rocker arm 68. The piston and cylinder assembly 86 extends from a pivot point 92 adjacent the top end 40 of the stanchion 36 to pivot point 94 on rocker arm 74.

The piston and cylinder assemblies 84 and 86 undergo substantially identical simultaneous operation to raise and lower the parking platform 42. This operation is shown in greater detail in FIGS. 2–4 which depict the side apparatus 10 on which piston and cylinder assembly 86 is disposed. In particular, the piston and cylinder assembly 86 comprises a piston 98 slidably disposed within a hydraulic cylinder 100. The cylinder 100 is pivotally connected to the top end 40 of stanchion 36 at pivot point 92. Similarly, the piston 98 is pivotally connected to the rocker arm 74 at pivot point 94, which is located approximately midway along the length of the rocker arm 74.

The slidable advancement of the piston 98 out of the cylinder 100 causes the pivot point 94 on rocker arm 74 to move downwardly. Conversely, the slidable retraction of the piston 98 into the cylinder 100 causes the pivot point 94 on the rocker arm 74 to advance upwardly. However, the movement of the rocker arm 74 is limited and positively controlled by the pivotal connection to the control arm 76 at pivot point 78. More particularly, the movement of the pivot point 94 under the action of the piston 98 will cause a substantial pivotal movement of the rocker arm 74 about pivot point 78. The relative radial position of pivot points 80 and 94 with respect to pivot point 78 cause the pivot point 80 to move a greater distance than pivot point 94 as the rocker arm 74 moves through an arc around the pivot point 78. Thus, any movement of the piston 98 will cause a substantially greater movement of pivot point 80.

As noted above, the pivot point 80 is attached to the side rail 46 of parking platform 42 which in turn is movable along stanchion 36. Consequently, any movement of piston 98 will cause a substantially greater movement of the parking platform up or down along stanchions 34 and 36. The maximum extension of piston 98 will cause pivot point 80 and parking platform 42 to move completely down into proximity with longitudinal support 16 as shown in FIG. 3. In this condition, the parking platform 42 will be in a position to receive a vehicle thereon.

The vehicle will be raised by the retraction of the piston 98 into the cylinder 100 under appropriately applied hydraulic force. As the piston 98 is retracted, both the pivot point 80 and the pivot point 94 will advance upwardly. However, the pivot point 80 will move a substantially greater distance in view of the relative difference in distance of pivot points 80 and 94 from pivot point 78. When the piston 98 achieves its fully retracted position in cylinder 96, the platform 42 will be in a fully raised position relative to the stanchion 34 as shown in FIG. 4.

As explained above, the parking apparatus 10 performs the lifting work during the pulling strokes of the piston and cylinder assemblies 84 and 86. The relative locations of the pivot points along the rocker arms 68 and 74 enables the piston and cylinder assemblies 84 and 86 to lift the parking platform a distance approximately twice the maximum movement of the respective pistons. Thus, the linkage between the piston and cylinder assemblies 84 and 86 and the respective articulated stabilizer arms 64 and 66 enables the parking platform 42 to be raised to the required elevation by an apparatus that does not exceed the height of the stanchions 34 and 36. Furthermore, the lifting forces are applied through the same mechanisms that stabilize the parking platform 42. In particular, the piston and cylinder assemblies 84 and 86 are attached to the articulated stabilizer bar assemblies 64 and 66 and contribute to the stabilization of the parking platform 42. By pulling on the articulated stabilizer bar assemblies 64 and 66, the parking apparatus 10 ensures a high degree of stabilization throughout the lifting process.

Figure 5:
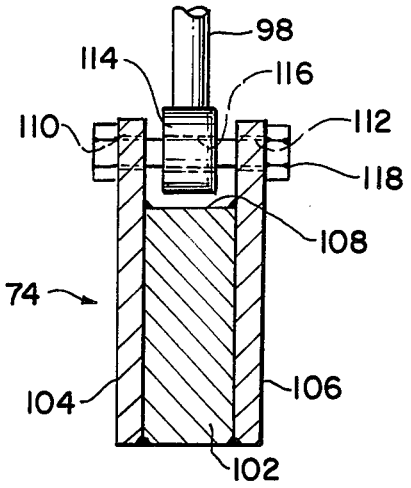
FIG. 5 is a cross-sectional view taken along line 5—5 in FIG. 2.

In the preferred embodiment, as illustrated in FIG. 5, the rocker arm 74 comprises a central beam 102 which is substantially rectangular in cross section, and a pair of flanges 104 and 106 securely attached to opposed longitudinal sides of the beam 102. The flanges 104 and 106 have a greater height than the beam 102 to define a longitudinally extending channel 108 between the flanges 104 and 106 and the beam 102. The flanges 104 and 106 are provided with generally circular apertures 110 and 112 respectively extending through portions thereof which define the channel 108. The piston 98 terminates at end 114 and also is provided with an aperture 116 extending therethrough. An appropriate fastening means, such as bolt 118, extends through the apertures 110, 112 and 116 to securely but pivotally connect the piston 98 to the rocker arm 74. In this embodiment, the flanges 104 and 106 contribute to the strength and stability of the rocker arm 74. Additionally, the channel 108 defines an area into which portions of the piston 98 may rotate as the piston 98 approaches its fully retracted position corresponding to the maximum elevation of the parking platform 42.

In summary, a low profile vehicle parking apparatus is provided. The parking apparatus includes a base and a pair of upstanding stanchions. A parking platform is disposed intermediate the stanchions and can be raised or lowered along the stanchions. A pair of articulated stabilizer bar assemblies extends between the base and the parking platform to provide stabilized movement of the parking platform. Each articulated stabilizer bar assembly comprises a rocker arm pivotally connected to the parking platform and a control arm pivotally connected to both the base and the end of the rocker arm remote from the parking platform. Piston and cylinder assemblies are connected to the ends of the stanchions remote from the base and to the respective rocker arms. The full extension of the pistons from the cylinders moves the parking platform into the fully lowered position, while the retraction of the pistons into the cylinders raises the parking platform to its maximum elevation. The forces exerted by the piston and cylinder assemblies act through the articulated stabilizer bar assemblies to further enhance the stabilization. Furthermore, the positions of the piston and cylinder assemblies provide a desirably low profile for the vehicle parking apparatus.

While the invention has been described with respect to a preferred embodiment, it is apparent that various changes can be made without departing from the scope of the invention as defined by the appended claims.

What is claimed is:

1. A vehicle parking apparatus comprising:

a base;

a pair of spaced apart upstanding stanchions rigidly connected to said base;

a parking platform disposed intermediate said stanchions and movable along said stanchions between a first position substantially adjacent said base and a second position elevated from said base;

a pair of articulated stabilizer bar assemblies, each said assembly comprising a rocker arm and a control arm articulated to one another, said control arms being pivotally connected to said base at locations thereon spaced from stanchions, said rocker arms being pivotally connected to said parking platform at locations thereon adjacent the respective stanchions; and a pair of piston and cylinder assemblies, each said piston and cylinder assembly being pivotally connected at one end to a location adjacent an end of the stanchion remote from the base and spaced from said stabilizer bar assemblies and being pivotally connected at the opposed end to one said rocker arm at a location along the associated rocker arm intermediate the control arm and the stanchion, whereby each piston and cylinder assembly is operative to exert forces on the associated rocker arm for raising or lowering the parking platform and to simultaneously contribute to the stabilization of the parking platform.

2. A parking apparatus as in claim 1 wherein the piston and cylinder assembly comprises a cylinder and a piston slidably disposed therein, said cylinder being pivotally mounted to said stanchion, and said piston being pivotally mounted to said rocker arm.

3. A parking apparatus as in claim 1 wherein each said piston and cylinder assembly is connected to the respective rocker arm at an approximately central location on said rocker arm.

4. A parking apparatus as in claim 1 wherein said base comprises a pair of parallel spaced apart longitudinal supports and a transverse support rigidly connected to and extending between said longitudinal supports, said stanchions being rigidly connected to said longitudinal supports of said base.

5. A parking apparatus as in claim 4 wherein the control arm of each said piston and cylinder assembly is pivotally connected to a location on one of said longitudinal supports remote from the associated stanchion.

6. A parking apparatus for mounting to a base comprising:

a pair of parallel spaced apart generally upstanding stanchions having opposed upper and lower ends, the lower ends being mounted to the base;

a parking platform disposed generally intermediate said stanchions and mounted thereto for movement along said stanchions;

a pair of control arms pivotally connected to fixed locations spaced from said stanchions;

a pair of rocker arms, each said rocker arm having a first pivot location pivotally connected respectively to said control arms and a second pivot location pivotally connected to said parking platform at a fixed location thereon generally adjacent the respective stanchion; and a pair of piston and cylinder assemblies, each said piston and cylinder assembly having first and second opposed ends, the first end of each said piston and cylinder assembly being pivotally connected to one said rocker arm at a location between the first and second pivot locations thereof, the second end of each said piston and cylinder assembly being pivotally connected to a location on the stanchions near the upper ends thereof, whereby the piston and cylinder assemblies are operative to move the rocker arms about the respective first pivot points to selectively raise or lower the parking platform and to simultaneously contribute to the stabilization of the parking platform.

7. A low profile parking apparatus comprising:

first and second substantially parallel spaced apart longitudinal supports;

first and second upstanding stanchions rigidly connected to said first and second longitudinal supports respectively and extending generally orthogonally therefrom;

a parking platform intermediate said first and second stanchions and movable therealong from a first position substantially adjacent said first and second longitudinal supports to a second position spaced therefrom;

first and second control arms pivotally connected to said first and second longitudinal supports at locations thereon spaced from said stanchions;

first and second rocker arms each having one end pivotally connected to said respective first and second control arms and each having its opposed end pivotally connected to said parking platform at locations on said parking platform generally adjacent the respective stanchions; and first and second piston and cylinder assemblies each having opposed first and second ends, the first ends being pivotally connected respectively to fixed locations on said respective stanchions near an end thereof remote from the longitudinal supports, the respective second ends of said first and second piston and cylinder assemblies being pivotally connected to said first and second rocker arms at locations thereon spaced from the pivotal connections of said first and second rocker arms to said parking platform and to said respective first and second control arms.

* * * * *